US010767668B2

(12) United States Patent
Son et al.

(10) Patent No.: US 10,767,668 B2
(45) Date of Patent: Sep. 8, 2020

(54) HYDRAULIC CONTROL SYSTEM FOR CONSTRUCTION MACHINE

(71) Applicant: Volvo Construction Equipment AB, Eskilstuna (SE)

(72) Inventors: Youngjin Son, Gyeongsangnam-do (KR); Sewan An, Gyeongsangnam-do (KR)

(73) Assignee: Volvo Construction Equipment AB, Ekilstuna (SE)

( * ) Notice: Subject to any disclaimer, the term of this patent is extended or adjusted under 35 U.S.C. 154(b) by 0 days.

(21) Appl. No.: 16/346,765

(22) PCT Filed: Nov. 2, 2016

(86) PCT No.: PCT/KR2016/012543
§ 371 (c)(1),
(2) Date: Jul. 7, 2019

(87) PCT Pub. No.: WO2018/084332
PCT Pub. Date: May 11, 2018

(65) Prior Publication Data

US 2019/0330824 A1 Oct. 31, 2019

(51) Int. Cl.
*F15B 11/17* (2006.01)
*E02F 9/22* (2006.01)
(Continued)

(52) U.S. Cl.
CPC ..... *F15B 11/17* (2013.01); *E02F 9/2267* (2013.01); *E02F 9/2285* (2013.01);
(Continued)

(58) Field of Classification Search
CPC ..... F15B 11/166; F15B 11/17; E02F 9/2267; E02F 9/2285; E02F 9/2292
See application file for complete search history.

(56) References Cited

U.S. PATENT DOCUMENTS 5,083,428 A * 1/1992 Kubomoto ..... E02F 9/2239 60/421
7,155,908 B2 * 1/2007 Jeon ..... E02F 9/2267 60/429
(Continued)

FOREIGN PATENT DOCUMENTS

JP 2008115990 A 5/2008
KR 20030058373 A 7/2003
(Continued)

OTHER PUBLICATIONS

International Search Report and Written Opinion of the International Searching Authority, PCT/KR2016/012543, dated Jul. 17, 2017 (including English translation of International Search Report), 10 pages.

*Primary Examiner* — Michael Leslie
(74) *Attorney, Agent, or Firm* — Sage Patent Group

(57) ABSTRACT

A hydraulic control system for a construction machine includes a hydraulic pump group including a first hydraulic pump, a second hydraulic pump and a third hydraulic pump; a main control valve including a first spool group that controls a flow of pressurised fluid from the first hydraulic pump and the second hydraulic pump and that includes an operation apparatus spool, a driving spool and a merging spool, a second spool group that controls a flow of pressurised fluid from the third hydraulic pump and that includes a rotating spool, and a straight driving valve between the first spool group and the second spool group; a first pilot signal line connected to the operation apparatus spool that provides a supply path for a pilot pressurised fluid that is applied to switch the operation apparatus spool; a second pilot signal line connected to the driving spool that provides a supply path for a pilot pressurised fluid that is applied to switch the driving spool; and a direction changing valve on the second pilot signal line connecting the driving spool and
(Continued)

a tank, that is connected to the first pilot signal line, and that is switched when the operation apparatus spool is switched so as to cut off the flow of a pilot pressurised fluid that is returning to the tank.

10 Claims, 3 Drawing Sheets

(51) Int. Cl.

| | |
|---|---|
| ***F15B 11/10*** | (2006.01) |
| ***F15B 13/04*** | (2006.01) |
| ***F15B 13/043*** | (2006.01) |
| ***F15B 11/16*** | (2006.01) |

(52) U.S. Cl.

CPC ..... *E02F 9/2292* (2013.01); *F15B 11/10* (2013.01); *F15B 11/166* (2013.01); *F15B 13/0402* (2013.01); *F15B 13/043* (2013.01); *F15B 2211/20576* (2013.01); *F15B 2211/40576* (2013.01); *F15B 2211/428* (2013.01); *F15B 2211/6355* (2013.01)

(56) References Cited

U.S. PATENT DOCUMENTS

| | | | | |
|---|---|---|---|---|
| 8,607,557 | B2 * | 12/2013 | Ikeda | E02F 9/123 60/421 |
| 9,181,677 | B2 * | 11/2015 | Saotome | E02F 3/36 |
| 9,790,659 | B2 * | 10/2017 | Sugano | F15B 11/17 |
| 2010/0000211 | A1 | 1/2010 | Ikeda et al. | |
| 2017/0037600 | A1 * | 2/2017 | Joung | E02F 9/2232 |
| 2019/0177953 | A1 * | 6/2019 | Takahashi | F15B 11/00 |

FOREIGN PATENT DOCUMENTS

| | | | | |
|---|---|---|---|---|
| KR | 20030058378 | A | * | 7/2003 |
| KR | 1020050066041 | A | | 6/2005 |
| KR | 20100004049 | A | | 1/2010 |
| KR | 101080173 | B1 | | 11/2011 |

* cited by examiner

HYDRAULIC CONTROL SYSTEM FOR CONSTRUCTION MACHINE

CROSS REFERENCE TO RELATED APPLICATIONS

This application is a 35 U.S.C. § 371 national stage application of PCT International Application No. PCT/KR2016/012543 filed on Nov. 2, 2016, the disclosure and content of which is incorporated by reference herein in its entirety.

TECHNICAL FIELD

The present invention relates to a hydraulic control system for a construction machine and, more specifically, to a hydraulic control system for a construction machine capable of enabling pressurized oil, which is to be discharged from a hydraulic pump not to be used for operation of a working device, to join pressurized oil, which is to be discharged from a hydraulic pump to be used for operation of the working device, by cutting off flow of pilot pressurized oil returning to a tank through a pilot signal line, thereby increasing a flow rate of pressurized oil to be used for operation of the working device to increase an operating speed of the working device.

BACKGROUND ART

In general, for a construction machine, for example, a small excavator, a hydraulic control system is adopted which is configured to enable traveling and to actuate a working device and an option device by controlling flow rates and flows of pressurized oils that are to be discharged from a plurality of hydraulic pumps through a main control valve (MCV) having a plurality of spools. For example, one hydraulic pump is configured to supply the pressurized oil to a left spool for traveling, a spool for a boom, a spool for a bucket and a spool for arm confluence. Also, the other hydraulic pump is configured to supply the pressurized oil to a right spool for traveling, a spool for an arm, a spool for an option device and a spool for boom confluence. In the case of the hydraulic control system in accordance with the related art, a spool for confluence may not be provided. However, in order to increase operating speeds of a boom and an arm with limited flow rates of the hydraulic pumps, a confluence system of the pressurized oils to be discharged from the respective hydraulic pumps is applied in most cases.

However, in the related art, even when the confluence system of the pressurized oils is applied, a desired operating speed is not obtained, so that a higher operating speed is required. Regarding this, if a capacity of the hydraulic pump is increased, the prime cost increases and an exterior size of the hydraulic pump increases, which makes it difficult to mount the hydraulic pump to the small excavator. Also, in the related art, even a bucket and an option device for which the high operating speed is not required are operated at high operating speeds upon the joining of the pressurized oils, so that there is a limitation in increasing the capacity of the hydraulic pump with no particular plan.

In the meantime, in a case where swing and a dozer are not used, an internal structure of the MCV is changed to enable a flow rate of the pressurized oil, which is discharged from a third hydraulic pump configured to supply the pressurized oil to the MCV, to join pressurized oil, which is supplied to a hydraulic actuator configured to actuate the boom or arm, thereby increasing the operating speed of the boom or arm. According to this method, however, it is necessary to considerably change the internal structure of the MCV.

SUMMARY OF INVENTION

Technical Problem

The present invention has been made in view of the above situations, and an object thereof is to provide a hydraulic control system for a construction machine capable of enabling pressurized oil, which is to be discharged from a hydraulic pump not to be used for operation of a working device, to join pressurized oil, which is to be discharged from a hydraulic pump to be used for operation of the working device, by cutting off flow of pilot pressurized oil returning to a tank through a pilot signal line, thereby increasing a flow rate of pressurized oil to be used for operation of the working device to increase an operating speed of the working device.

Solution to Problem

In order to achieve the above object, according to the present invention, there is provided a hydraulic control system for a construction machine including a hydraulic pump group including a first hydraulic pump, a second hydraulic pump and a third hydraulic pump; a main control valve (MCV) including a first spool group configured to control flow rates and flows of pressurized oils to be supplied from the first hydraulic pump and the second hydraulic pump and including a spool for a working device, a spool for traveling and a spool for confluence, a second spool group configured to control a flow rate and flow of pressurized oil to be supplied from the third hydraulic pump and including a spool for swing, and a straight traveling valve equipped between the first spool group and the second spool group; a first pilot signal line connected to the spool for a working device and configured to provide a supply passage of pilot pressurized oil to be applied so as to switch the spool for a working device; a second pilot signal line connected to the spool for traveling and configured to provide a supply passage of pilot pressurized oil to be applied so as to switch the spool for traveling, and a direction changing valve equipped on the second pilot signal line configured to interconnect the spool for traveling and a tank, connected to the first pilot signal line, and configured to be switched upon switching of the spool for a working device, thereby cutting off flow of pilot pressurized oil returning to the tank.

The straight traveling valve may be switched by a pressure that is formed by the pilot pressurized oil of which returning flow to the tank is cut off by the switching of the spool for a working device and the pilot pressurized oil of which returning flow to the tank is cut off by the direction changing valve, upon the switching of the spool for a working device.

The pressurized oil that is discharged from the third hydraulic pump may be supplied to the first spool group in accordance with the switching of the straight traveling valve and join the pressurized oils that are discharged from the first hydraulic pump and the second hydraulic pump and pass through the spool for a working device and the spool for confluence.

The hydraulic control system for a construction machine may further include a remote control valve (RCV) configured to apply a pilot signal pressure to the first spool group and the second spool group by a driver's manipulation thereon.

The direction changing valve may cut off the flow of the pilot pressurized oil returning to the tank when an operating amount of the RCV is a predetermined amount or larger in a state when the spool for a working device is switched.

The direction changing valve may be a solenoid valve.

The hydraulic control system for a construction machine may further include a changeover switch electrically connected to the direction changing valve and configured to actuate the direction changing valve by a driver's on/off manipulation.

The direction changing valve may cut off the flow of the pilot pressurized oil returning to the tank when the changeover switch is on in a state where the spool for a working device is switched.

The direction changing valve may be arranged inside the MCV.

The direction changing valve may be arranged outside the MCV.

Advantageous Effects of Invention

According to the present invention, the direction changing valve equipped on the pilot signal line at the spool for traveling and configured to cut off the flow of the pilot pressurized oil returning to the tank is provided. Therefore, it is possible to enable the pressurized oil, which is to be discharged from a hydraulic pump not to be used for operation of the working device, to join the pressurized oil, which is to be discharged from a hydraulic pump to be used for operation of the working device. Thereby, it is possible to considerably increase a flow rate of the pressurized oil to be used for operation of the working device, so that it is possible to increase an operating speed of the working device by the increase in flow rate.

Also, according to the present invention, since the direction changing valve has only to be arranged on the pilot signal line inside or outside the MCV, it is possible to solve problems of limitations, reluctances and the like relating to a change of an internal structure of the MCV.

Also, according to the present invention, an actuation pressure of the direction changing valve is set so that the direction changing valve is to be actuated when the remote control valve (RCV) is manipulated by the predetermined amount or larger (for example, at least 50% or larger). Therefore, it is possible to increase the speed only for the operation of the working device for which it is particularly required to increase the speed. That is, according to the present invention, it is possible to satisfy a variety of operation patterns desired by the driver.

Also, according to the present invention, the direction changing valve is configured by the solenoid valve and the changeover switch electrically connected thereto is provided in an operator's cab, so that the driver can directly determine whether or not to join the pressurized oil by the on/off manipulation on the switch.

DESCRIPTION OF EMBODIMENTS

Hereinafter, a hydraulic control system for a construction machine in accordance with embodiments of the present invention will be described in detail with reference to the accompanying drawings.

When describing the present invention, the specific descriptions of the related well-known functions or configurations will be omitted if it is considered that the descriptions make the gist of the present invention unclear.

Figure 1:
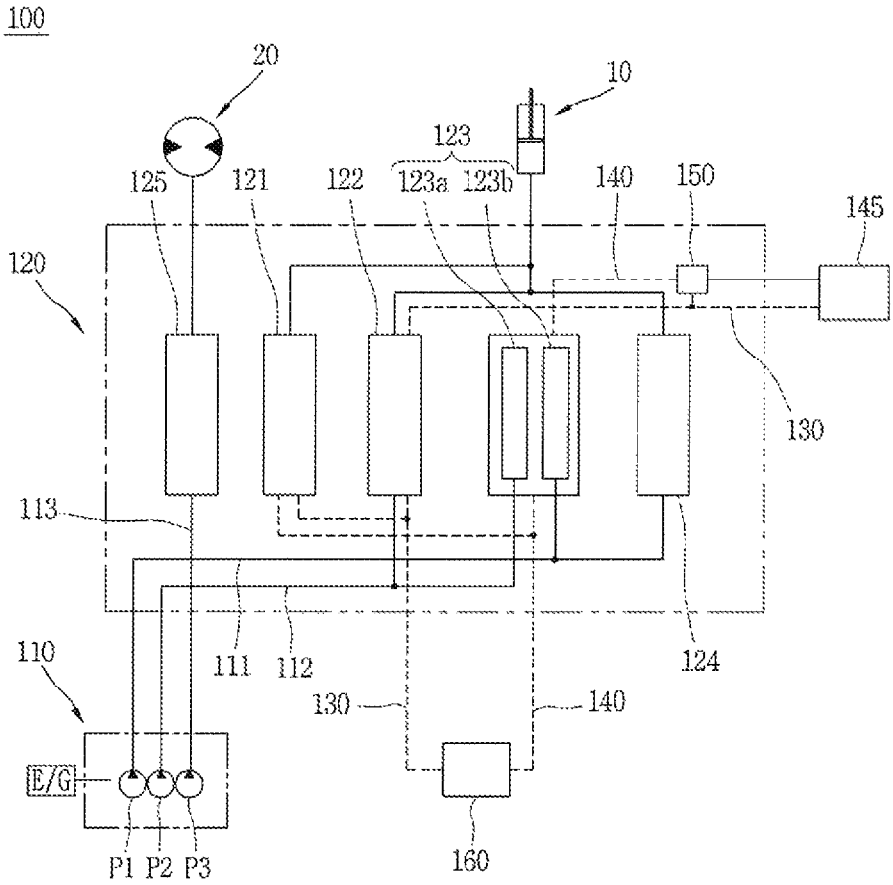
FIG. 1 is a hydraulic circuit diagram depicting a hydraulic control system for a construction machine in accordance with a first embodiment of the present invention.

As shown in FIG. 1, a hydraulic control system 100 for a construction machine in accordance with a first embodiment of the present invention is a system configured to control traveling and swinging operations of a construction machine, for example an excavator, and operations of a working device such as a boom, an arm and a bucket equipped to the excavator and an option device such as a hammer, a shear, a rotator and the like. To this end, the hydraulic control system 100 for a construction machine in accordance with the first embodiment of the present invention includes a hydraulic pump group 110, a main control valve (MCV) 120, a first pilot signal line 130, a second pilot signal line 140 and a direction changing valve 150. The hydraulic control system 100 for a construction machine in accordance with the first embodiment of the present invention is a system capable of supplying an additional flow rate to a hydraulic actuator of a working device, which requires a large flow rate, thereby increasing an operating speed of the corresponding working device. As the hydraulic actuator of the working device, an arm cylinder 10 is exemplified. However, the present invention is not limited thereto. For example, the hydraulic actuator of the working device may be a boom cylinder.

The hydraulic pump group 110 is a set of hydraulic pumps configured to supply pressurized oil to the MCV 120. The hydraulic pumps are driven by an engine (E/G). In the first embodiment of the present invention, the hydraulic pump group 110 includes a first hydraulic pump P1, a second hydraulic pump P2 and a third hydraulic pump P3.

The first hydraulic pump P1 is connected to the MCV 120 through a first flow path 111. For example, pressurized oil that is discharged from the first hydraulic pump Pt is supplied to a spool 124 for confluence provided inside the MCV 120 through the first flow path 111. Also, the second hydraulic pump P2 is connected to the MCV 120 through a second flow path 112. Pressurized oil that is discharged from the second hydraulic pump P2 is supplied to a spool 122 for a working device provided inside the MCV 120 through the second flow path 112.

When the spool 124 for confluence and the spool 122 for a working device are switched by pilot pressurized oil applied as a result of a driver's manipulation on a remote control valve (RCV) 160, the pressurized oil, which has been discharged from the first hydraulic pump P1 and has passed through the spool 124 for confluence, joins the pressurized oil, which has been discharged from the second hydraulic pump P2 and has passed through the spool 122 for a working device, inside or outside the MCV 120, and the joined oil is supplied to the hydraulic actuator, for example, the arm cylinder 10. Thereby, the arm cylinder 10 is driven, so that an arm is actuated.

In the meantime, the third hydraulic pump P3 is connected to the MCV 120 through a third flow path 113. Pressurized oil that is discharged from the third hydraulic pump P3 is supplied to a spool 125 for swing provided inside the MCV 120 through the third flow path 113. When the spool 125 for swing is switched by pilot pressurized oil applied as a result of a driver's manipulation on the RCV 160, the pressurized oil discharged from the third hydraulic pump P3 and having passed through the spool 125 for swing is supplied to a swing motor 20. Thereby, the swing motor 20 is rotated in a forward or reverse direction, so that an upper swing structure of the excavator swings in a corresponding direction.

In a state where the swing motor 20 is stopped, the pressurized oil discharged from the third hydraulic pump P3 joins the pressurized oils discharged from the first hydraulic pump P1 and the second hydraulic pump P2 and to be supplied to the arm cylinder 10, which will be described later in more detail.

The MCV 120 is a device configured to control flow rates and flows of the pressurized oils to be supplied from the first hydraulic pump P1, the second hydraulic pump P2 and the third hydraulic pump P3, thereby enabling the traveling and driving the hydraulic actuators configured to actuate the working device and the option device. In the first embodiment of the present invention, the MCV 120 includes a first spool group, a second spool group and a straight traveling valve 121.

The first spool group is configured to control flow rates and flows of the pressurized oils to be discharged from the first hydraulic pump P1 and the second hydraulic pump P2 and to be supplied through the first flow path 111 and the second flow path 112. To this end, the first spool group includes a spool 122 for a working device, a spool 123 for traveling, and a spool 124 for confluence.

The spool 122 for a working device is configured to control a flow rate and flow of the pressurized oil to be supplied from the second hydraulic pump P2. The spool 122 for a working device may include a spool for a boom, a spool for a bucket and a spool for an arm. Also, the spool 124 for confluence is configured to control a flow rate and flow of the pressurized oil to be supplied from the first hydraulic pump P1. The spool 124 for confluence may include a spool for arm confluence and a spool for boom confluence. The spool 123 for traveling has a left spool 123*a* for traveling and a right spool 123*b* for traveling. The left spool 123*a* for traveling is configured to control a flow rate and flow of the pressurized oil to be discharged from the second hydraulic pump P2, and the right spool 123*b* for traveling is configured to control a flow rate and flow of the pressurized oil to be discharged from the first hydraulic pump P1.

The second spool group is configured to control a flow rate and flow of the pressurized oils to be discharged from the third hydraulic pump P3 and to be supplied through the third flow path 113. To this end, the second spool group includes a spool 125 for swing.

The straight traveling valve 121 is equipped between the first spool group and the second spool group. In the first embodiment of the present invention, the straight traveling valve 121 is configured to be switched by an operation of the direction changing valve 150 in a working mode of the excavator, thereby enabling the pressurized oil discharged from the third hydraulic pump P3 to join the pressurized oil to be supplied to the arm cylinder 10, which will be described later in more detail.

The first pilot signal line 130 is connected to the spool 122 for a working device. The first pilot signal line 130 is to provide a supply passage of the pilot pressurized oil that is to be applied so as to switch the spool 122 for a working device as a result of the driver's manipulation on the RCV 160. When the spool 122 for a working device is switched, the first pilot signal line 130 is cut off. Thereby, the returning flow of the pilot pressurized oil, which has been applied to the spool 122 for a working device, to a tank 145 through the first pilot signal line 130 is cut off. This means that when the first pilot signal line 130 is cut off, the working device is operating.

That is, it is possible to perceive whether the arm cylinder 10 is driven, for example, and whether the arm is correspondingly actuated, through the cutoff of the first pilot signal line 130. Therefore, when the first pilot signal line 130 is not cut off in a state where the engine (E/G) is in a starting state, in other words, when the pilot pressurized oil flowing through the first pilot signal line 130 is returning to the tank 145, it is determined that that the arm is not actuated, and control may be performed so that the number of revolutions of the engine (E/G) is to be minimum.

The second pilot signal line 140 is connected to the spool 123 for traveling. The second pilot signal line 140 is to provide a supply passage of the pilot pressurized oil that is to be applied so as to switch the spool 123 for traveling as a result of the driver's manipulation on the RCV 160. When the spool 123 for traveling is switched, the second pilot signal line 140 is cut off. Thereby, the returning flow of the pilot pressurized oil, which has been applied to the spool 123 for traveling, to the tank 145 through the second pilot signal line 140 is cut off. This means that when the second pilot signal line 140 is cut off, the excavator is traveling. Therefore, it is possible to give a warning such as a traveling alarm to persons around the excavator.

The direction changing valve 150 is equipped on the second pilot signal line 140 configured to interconnect the spool 123 for traveling and the tank 145. Also, the direction changing valve 150 is connected to the first pilot signal line 130. In the first embodiment of the present invention, the direction changing valve 150 is arranged inside the MCV 120.

The direction changing valve 150 is connected to the first pilot signal line 130 configured to provide a supply passage of the pilot pressurized oil that is to be applied to the spool 122 for a working device, so that when the spool 122 for a working device is switched, the direction changing valve is also switched to cut off the flow of the pilot pressurized oil returning to the tank 145 through the second pilot signal line 140. In this way, when the returning flow of the pilot pressurized oil is cut off by the direction changing valve 150 upon the switching of the spool 122 for a working device, the straight traveling valve 121 is switched by a pressure formed by the pilot pressurized oil. Thereby, the pressurized oil discharged from the third hydraulic pump P3 is supplied to the first spool group, and joins the pressurized oils discharged from the first hydraulic pump P1 and the second hydraulic pump P2 and having passed through the spool 122 for a working device and the spool 124 for confluence.

Like this, when the pressurized oil discharged from the third hydraulic pump P3, which is used for swing operation and is not used for operation of the working device, joins the pressurized oils discharged from the hydraulic pumps P1, P2, which are used for operation of the working device, it is possible to further increase the flow rate of the pressurized oil to be used for operation of the working device, so that it is possible to increase an operating speed of the working device such as a boom and an arm, which requires a large flow rate, by the increase in flow rate.

In the meantime, the direction changing valve 150 in accordance with the first embodiment of the present invention may be switched depending on an operating amount of the RCV 160. Specifically, when the spool 122 for a working device is switched and the operating amount of the RCV 160 at this time is a preset amount (for example 50%), the direction changing valve 150 is switched to cut off the flow of the pilot pressurized oil returning to the tank 145 through the second pilot signal line 140. Here, the case where the operating amount of the RCV 160 is 50% is further described. A pressure of the pilot pressurized oil to be applied at this time is usually set to 14 bar. That is, in the first embodiment of the present invention, an actuation pressure of the direction changing valve 150 may be set so that the direction changing valve is to be switched when the pressure of the pilot pressurized oil passing through the second pilot signal line 140 is 14 bar or higher (i.e., when the preset operating amount of the RCV is 50%).

When the actuation pressure of the direction changing valve 150 is set in this way, even though the spool 122 for a working device is switched, the pressurized oil discharged from the third hydraulic pump P3 does not join the pressurized oils discharged from the first hydraulic pump P1 and the second hydraulic pump P2 and to be supplied to the hydraulic actuator, for example, the arm cylinder 10. That is, when the actuation pressure of the direction changing valve 150 is set as described above, if the RCV 160 is operated by an amount less than the preset amount, the pressurized oil discharged from the third hydraulic pump P3 is not joined, so that it is possible to finely manipulate the working device, for example, the arm. Also, when the RCV 160 is operated by the preset amount or larger, the pressurized oil discharged from the third hydraulic pump P3 is joined, so that it is possible to increase an operating speed of the arm.

In the below, operations of the hydraulic control system for a construction machine in accordance with the first embodiment of the present invention are described. In the below, an arm-in operation is described as an example. Thus, an arm cylinder is exemplified as the hydraulic actuator, a spool for an arm is exemplified as the spool for a working device, and a spool for arm confluence is exemplified as the spool for confluence. Also, for convenience of descriptions, the same reference numerals are used.

First, when there is no manipulation on the RCV 160 in the starting state, the pilot pressurized oil supplied to an entry of the straight traveling valve 121 returns to the tank 145 through the first pilot signal line 130 and the second pilot signal line 140.

At this time, when an arm-in operation is performed through the RCV 160, the spool 122 for an arm and the spool 124 for arm confluence are switched, so that the pressurized oils discharged from the first hydraulic pump P1 and the second hydraulic pump P2 pass through the spool 122 for an arm and the spool 124 for arm confluence and are then primarily joined, which is then supplied to the arm cylinder 10. As a result, the arm cylinder 10 is driven. At this time, as the spool 122 for an arm is switched, the direction changing valve 150 connected to the first pilot signal line 130 configured to provide the supply passage of the pilot pressurized oil to be applied to the spool 122 for an arm is also switched. The direction changing valve 150 equipped on the second pilot signal line 140 is switched, so that the flow of the pilot pressurized oil returning to the tank 145 through the second pilot signal line 140 is cut off. Here, the actuation pressure of the direction changing valve 150 may be set so that it is to be switched only when the operating amount of the RCV 160 is the preset amount or larger.

When the spool 122 for an arm is switched in this way, the pilot pressurized oil supplied to the entry of the straight traveling valve 121 and passing through the first pilot signal line 130 cannot return to the tank 145. When the direction changing valve 150 is switched as the spool 122 for an arm is switched, the pilot pressurized oil supplied to the entry of the straight traveling valve 121 and having passed through the second pilot signal line 140 cannot also return to the tank 145. As a result, the straight traveling valve 121 is switched by a pressure formed by the pilot pressurized oils of which returning flows to the tank 145 are cut off.

When the straight traveling valve 121 is switched in this way, the pressurized oil discharged from the third hydraulic pump P3 that is not used for drive of the arm cylinder 10 is supplied to the first spool group through the straight traveling valve 121 and is additionally supplied, i.e., secondarily joins the pressurized oils discharged from the first hydraulic pump P1 and the second hydraulic pump P2, and passing through the spool 122 for an arm and the spool 124 for arm confluence. Then, the pressurized oil obtained as a result of the final joining of the pressurized oils discharged from the first hydraulic pump P1, the second hydraulic pump P2 and the third hydraulic pump P3 is supplied to the arm cylinder 10. In this way, the arm cylinder 10 is driven at high speed by the pressurized oil supplied in a large amount, so that the arm is also actuated at high speed.

Subsequently, a hydraulic control system for a construction machine in accordance with a second embodiment of the present invention is described with reference to FIG. 2.

Figure 2:
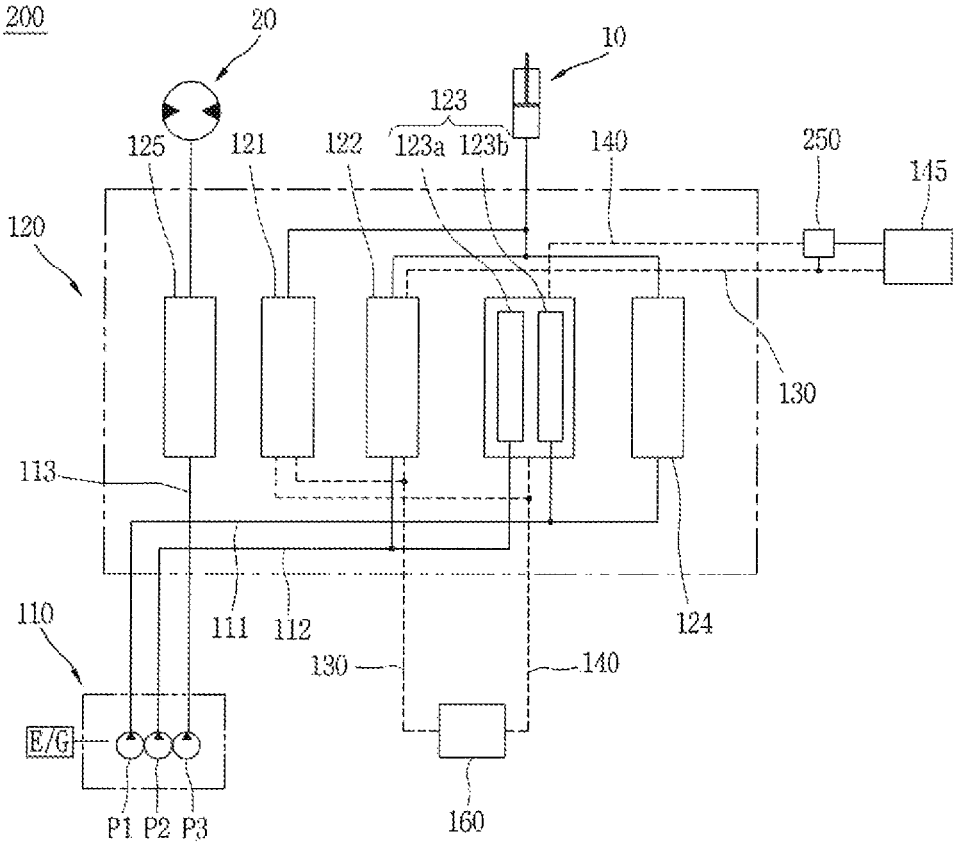
FIG. 2 is a hydraulic circuit diagram depicting a hydraulic control system for a construction machine in accordance with a second embodiment of the present invention.

FIG. 2 is a hydraulic circuit diagram depicting a hydraulic control system for a construction machine in accordance with a second embodiment of the present invention.

As shown in FIG. 2, a hydraulic control system 200 for a construction machine in accordance with the second embodiment of the present invention includes the hydraulic pump group 110, the MCV 120, the first pilot signal line 130, the second pilot signal line 140 and a direction changing valve 250.

In the second embodiment of the present invention, only a provision position of the direction changing valve is different from the first embodiment of the present invention and the other constitutional elements are the same. Therefore, the same constitutional elements are denoted with the same reference numerals, and the descriptions thereof are omitted.

In the second embodiment of the present invention, the direction changing valve 250 is equipped on the second pilot signal line 140 configured to interconnect the spool 123 for traveling and the tank 145. Also, the direction changing valve 250 is connected to the first pilot signal line 130. The direction changing valve 250 is arranged outside the MCV 120. Even when the direction changing valve 250 is arranged outside the MCV 120, it is possible to accomplish the same effects as the first embodiment of the present invention in which the direction changing valve 150 (FIG. 1) is arranged inside the MCV 120. In the second embodiment of the present invention, the direction changing valve 250 is arranged outside the MCV 120, so that when the direction changing valve 250 malfunctions, it is possible to conveniently inspect and repair the direction changing valve without dismantling or disassembling the MCV 120.

Subsequently, a hydraulic control system for a construction machine in accordance with a third embodiment of the present invention is described with reference to FIG. 3.

Figure 3:
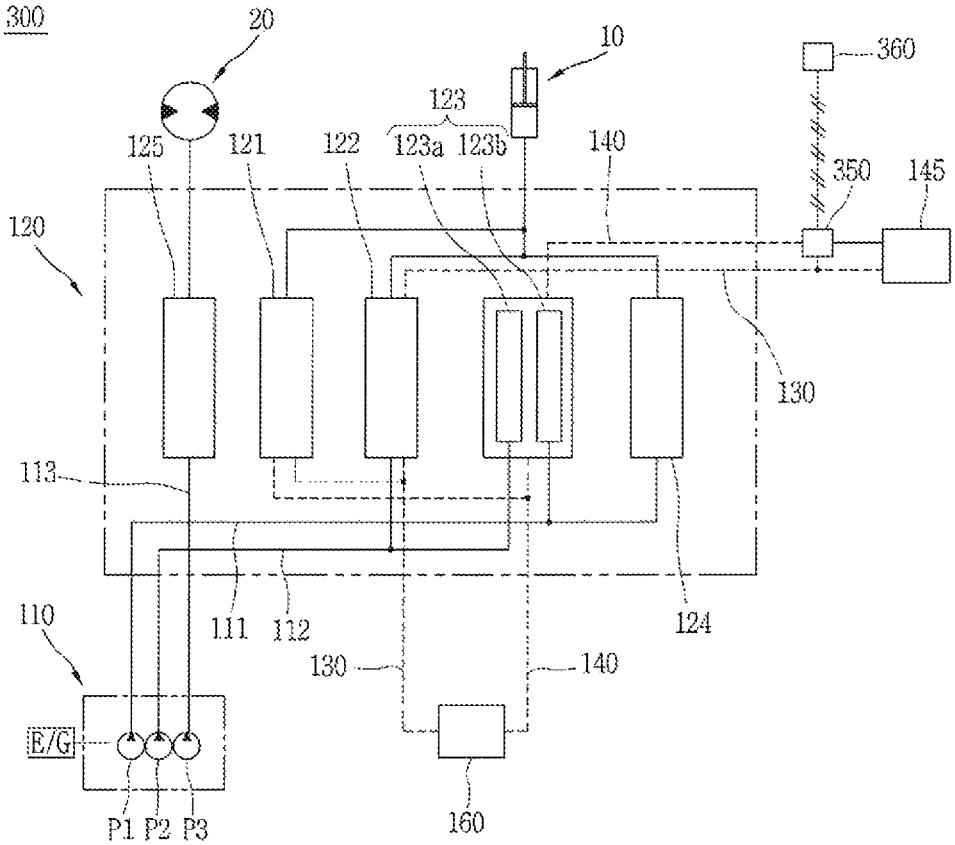
FIG. 3 is a hydraulic circuit diagram depicting a hydraulic control system for a construction machine in accordance with a third embodiment of the present invention.

FIG. 3 is a hydraulic circuit diagram depicting a hydraulic control system for a construction machine in accordance with a third embodiment of the present invention.

As shown in FIG. 3, a hydraulic control system 300 for a construction machine in accordance with the third embodiment of the present invention includes the hydraulic pump group 110, the MCV 120, the first pilot signal line 130, the second pilot signal line 140, a direction changing valve 350 and a changeover switch 360.

The third embodiment of the present invention is different from the second embodiment of the present invention, in terms of a type of the direction changing valve and the changeover switch, and the other constitutional elements are the same. Therefore, the same constitutional elements are denoted with the same reference numerals, and the descriptions thereof are omitted.

In the third embodiment of the present invention, the direction changing valve 350 is equipped on the second pilot signal line 140 configured to interconnect the spool 123 for traveling and the tank 145. Also, the direction changing valve 350 is arranged outside the MCV 120. The direction changing valve 350 may be configured by a solenoid valve.

The changeover switch 360 is equipped in an operator's cab of the excavator. The changeover switch 360 is electrically connected to the direction changing valve 350 configured by a solenoid valve, and is configured to actuate the direction changing valve 350 by a driver's on/off manipulation. Therefore, even when the spool 122 for a working device is switched, the direction changing valve 350 is not switched. When the changeover switch 360 becomes on as a result of the driver's manipulation thereon, the direction changing valve is switched by an electric signal transmitted from the changeover switch, thereby cutting off the flow of the pilot pressurized oil returning to the tank 145 through the second pilot signal line 140.

In the third embodiment of the present invention, as described above, the direction changing valve 350 is configured by the solenoid valve and the changeover switch 360 electrically connected thereto is provided in the operator's cab. By this configuration, the driver can directly determine whether or not to join the pressurized oil discharged from the third hydraulic pump P3, through the on/off manipulation on the changeover switch 360.

According to the third embodiment of the present invention, the pressurized oil discharged from the third hydraulic pump P3 is joined only for the operation of the working device, for which it is particularly required to increase the speed, so that it is possible to increase the operating speed of the working device. That is, according to the third embodiment of the present invention, it is possible to satisfy a variety of operation patterns desired by the driver.

Although the present invention has been described with reference to the specific embodiments and the drawings, the present invention is not limited to the embodiments, and a variety of variations and modifications can be made by one skilled in the art of the present invention.

Therefore, the scope of the present invention should not be defined by the above-described embodiments but should be defined by the appended claims and equivalents thereof.

The invention claimed is:

1. A hydraulic control system for a construction machine, the hydraulic control system comprising:

a hydraulic pump group comprising a first hydraulic pump, a second hydraulic pump and a third hydraulic pump;

a main control valve (MCV) comprising:

a first spool group configured to control flow rates and flows of pressurized oils to be supplied from the first hydraulic pump and the second hydraulic pump and comprising a spool for a working device, a spool for traveling and a spool for confluence, a second spool group configured to control a flow rate and flow of pressurized oil to be supplied from the third hydraulic pump and comprising a spool for swing, and a straight traveling valve equipped between the first spool group and the second spool group;

a first pilot signal line connected to the spool fora working device and configured to provide a supply passage of pilot pressurized oil to be applied so as to switch the spool for a working device;

a second pilot signal line connected to the spool for traveling and configured to provide a supply passage of pilot pressurized oil to be applied so as to switch the spool for traveling, and a direction changing valve equipped on the second pilot signal line configured to interconnect the spool for traveling and a tank, connected to the first pilot signal line, and configured to be switched upon switching of the spool for a working device, thereby cutting off flow of pilot pressurized oil returning to the tank.

2. The hydraulic control system according to claim 1, wherein the straight traveling valve is switched by a pressure that is formed by the pilot pressurized oil of which returning flow to the tank is cut off by the switching of the spool for a working device and the pilot pressurized oil of which returning flow to the tank is cut off by the direction changing valve, upon the switching of the spool for a working device.

3. The hydraulic control system according to claim 2, wherein the pressurized oil that is discharged from the third hydraulic pump is supplied to the first spool group in accordance with the switching of the straight traveling valve and joins the pressurized oils that are discharged from the first hydraulic pump and the second hydraulic pump and pass through the spool for a working device and the spool for confluence.

4. The hydraulic control system according to claim 1, further comprising a remote control valve (RCV) configured to apply a pilot signal pressure to the first spool group and the second spool group by a driver's manipulation thereon.

5. The hydraulic control system according to claim 4, wherein the direction changing valve cuts off the flow of the pilot pressurized oil returning to the tank when an operating amount of the RCV is a predetermined amount or larger in a state when the spool for a working device is switched.

6. The hydraulic control system according to claim 1, wherein the direction changing valve is a solenoid valve.

7. The hydraulic control system according to claim 6, further comprising a changeover switch electrically connected to the direction changing valve and configured to actuate the direction changing valve by a driver's on/off manipulation.

8. The hydraulic control system according to claim 7, wherein the direction changing valve cuts off the flow of the pilot pressurized oil returning to the tank when the changeover switch is on in a state where the spool for a working device is switched.

9. The hydraulic control system according to claim 1, wherein the direction changing valve is arranged inside the MCV.

10. The hydraulic control system according to claim 1, wherein the direction changing valve is arranged outside the MCV.

* * * * *